US011152177B2

(12) United States Patent
Lakemeyer et al.

(10) Patent No.: US 11,152,177 B2
(45) Date of Patent: Oct. 19, 2021

(54) SAFETY DEVICE FOR EMERGENCY SHUT-DOWN OF AN ELECTRIC INSTANTANEOUS WATER HEATER

(71) Applicant: Stiebel Eltron GmbH & Co. KG, Holzminden (DE)

(72) Inventors: Christoph Lakemeyer, Nieheim (DE); Michael Grobe, Höxter (DE); Olaf Diederich, Höxter (DE); Christian Arnemann, Höxter (DE)

(73) Assignee: Stiebel Eltron GmbH & Co. KG, Holzminden (DE)

( * ) Notice: Subject to any disclaimer, the term of this patent is extended or adjusted under 35 U.S.C. 154(b) by 180 days.

(21) Appl. No.: 16/479,322

(22) PCT Filed: Jan. 10, 2018

(86) PCT No.: PCT/EP2018/050508
§ 371 (c)(1),
(2) Date: Jul. 19, 2019

(87) PCT Pub. No.: WO2018/134092
PCT Pub. Date: Jul. 26, 2018

(65) Prior Publication Data

US 2019/0341212 A1 Nov. 7, 2019

(30) Foreign Application Priority Data

Jan. 19, 2017 (DE) ..... 10 2017000 438.2

(51) Int. Cl.
*F24H 9/20* (2006.01)
*H01H 71/08* (2006.01)
(Continued)

(52) U.S. Cl.
CPC ..... *H01H 71/08* (2013.01); *E03B 7/071* (2013.01); *F24H 1/101* (2013.01); *F24H 9/2028* (2013.01);
(Continued)

(58) Field of Classification Search
CPC ..... F24H 9/20; F24H 9/2007; F24H 9/2014; F24H 9/205; H01H 71/08;
(Continued)

(56) References Cited

U.S. PATENT DOCUMENTS 3,939,456 A * 2/1976 Curtis ..... F24H 9/20 340/519
4,978,821 A * 12/1990 Shon ..... F23N 5/247 200/83 W
(Continued)

FOREIGN PATENT DOCUMENTS

CN 1248384 3/2000
CN 1329470 1/2002
(Continued)

OTHER PUBLICATIONS

Search Report for Application No. PCT/EP2018/050508 dated May 3, 2018.
(Continued)

*Primary Examiner* — Gregory A Wilson
(74) *Attorney, Agent, or Firm* — Haug Partners LLP

(57) ABSTRACT

A safety device for emergency shut-down of an electric instantaneous water heater. The safety device includes a contact and a counter contact, which are set up to conduct the current for supplying the instantaneous water heater in a contacted state and to interrupt the power supply of the instantaneous water heater in an open state. Further, the safety device includes a mounting device for mounting the counter contact on a tie rod, wherein the tie rod is set up to
(Continued)

release the mounting device and the counter contact 4 from the contact to interrupt a power supply of the instantaneous water heater. The contact of the safety device is implemented as a contact rivet which is integrated directly into a circuit board.

13 Claims, 4 Drawing Sheets

(51) Int. Cl.

| | |
|---|---|
| ***F24H 1/10*** | (2006.01) |
| ***H05B 1/02*** | (2006.01) |
| ***E03B 7/07*** | (2006.01) |
| *H01H 71/24* | (2006.01) |

(52) U.S. Cl.
CPC ..... *H05B 1/0283* (2013.01); *F24H 9/2007* (2013.01); *H01H 71/24* (2013.01); *H01H 2201/024* (2013.01); *H01H 2203/004* (2013.01); *H01H 2207/02* (2013.01)

(58) Field of Classification Search
CPC ..... H01H 2203/004; H01H 2207/02; H01H 2201/024; H01H 2203/024; H01H 2071/088; H05B 1/0283
See application file for complete search history.

(56) References Cited

U.S. PATENT DOCUMENTS

| | | | | |
|---|---|---|---|---|
| 5,434,388 | A * | 7/1995 | Kralik | F24H 1/121 219/522 |
| 6,230,611 | B1 * | 5/2001 | Mauffrey | A47J 37/0821 219/521 |
| 7,007,316 | B2 * | 3/2006 | Lutz, II | G05D 23/1393 4/620 |
| 7,970,494 | B2 * | 6/2011 | Fima | F17D 5/02 700/282 |
| 8,955,308 | B2 * | 2/2015 | Bauer | F24H 9/2007 60/286 |
| 2010/0206869 | A1 * | 8/2010 | Nelson | F24H 9/2007 219/494 |

FOREIGN PATENT DOCUMENTS

| | | |
|---|---|---|
| CN | 201181780 | 1/2009 |
| CN | 102135322 | 7/2011 |
| CN | 103075811 | 5/2013 |
| CN | 103615806 | 3/2014 |
| CN | 103983020 | 8/2014 |
| DE | 898 498 | 11/1953 |
| DE | 966 816 | 9/1957 |
| DE | 11 61 975 | 1/1964 |
| DE | 10 60 060 | 6/1969 |
| DE | 15 14 889 | 9/1969 |
| DE | 37 39 712 | 6/1989 |
| DE | 42 27 358 | 2/1994 |
| DE | 101 04 438 | 8/2002 |
| DE | 699 05 937 | 12/2003 |
| DE | 103 46 771 | 4/2005 |
| DE | 10 2010 024 988 | 12/2011 |
| DE | 10 2011 013 810 | 9/2012 |
| JP | H05225871 | 9/1993 |

OTHER PUBLICATIONS

German Search Report for application No. 10 2017 000 438.2 dated Dec. 20, 2017.
Notification of The First Office Action for Chinese application No. 201880007510.8 dated Sep. 3, 2020.

* cited by examiner

SAFETY DEVICE FOR EMERGENCY SHUT-DOWN OF AN ELECTRIC INSTANTANEOUS WATER HEATER

The present application claims priority from International Patent Application No. PCT/EP2018/050508 filed on Jan. 10, 2018, which claims priority from German Patent Application No. DE 10 2017 100 438.2 filed on Jan. 19, 2017, the disclosures of which are incorporated herein by reference in their entirety.

FIELD OF THE INVENTION

It is noted that citation or identification of any document in this application is not an admission that such document is available as prior art to the present invention.

The invention relates to a safety device for emergency shut-down of an electric instantaneous water heater, the use of a contact rivet as contact in the safety device and an instantaneous water heater having the safety device.

It is known in the prior art to attach safety devices for shutting down instantaneous water heaters directly on the printed circuit board for the electrical control and supply of the instantaneous water heater. For this purpose, the safety devices make contact with the conductor tracks of the printed circuit board by means of contact carriers which are soldered or welded to the printed circuit board. In such an embodiment, for example, a contact rivet is disposed in the centre of the contact carrier and thus forms a conductive connection to a counter contact which is disposed on the safety device.

FIG. 1 shows such an embodiment of the prior art, wherein a contact carrier 22 is soldered onto a circuit board 21 and the contact carrier 22 comprises a contact rivet 23. In this embodiment of the prior art, on the one hand, the assembly is very complex, since each contact carrier must be soldered individually in two places and on the other hand, due to the often poorly conductive contact carrier, the high current flows that are typical for instantaneous water heaters result in an increased temperature development in the vicinity of the contacts, which is why additional measures are often required to divert the developed temperature away from the contacts.

SUMMARY OF THE INVENTION

It is therefore the object of the present invention to provide an improved safety device for an instantaneous water heater.

This object is achieved by a safety device for emergency shut-down of an electric instantaneous water heater, in particular an instantaneous water heater, or a heat pump, wherein the safety device comprises a contact and a counter contact, which are set up to conduct the current for supplying the instantaneous water heater in a contacted state and to interrupt the power supply of the instantaneous water heater in an open state. Further, the safety device comprises a mounting device for mounting the counter contact on a tie rod, wherein the tie rod is set up to release the mounting device and the counter contact from the contact to interrupt a power supply of the device, wherein the safety device is characterized in that the contact is implemented as a contact rivet, which is integrated directly into the circuit board.

Contact carriers used up to now in the prior art, as shown, for example, in FIG. 1, form a contact resistance between the contact and the contact carrier located on the circuit board when the contact makes contact with the counter contact, and thus when there is a current flow through the instantaneous water heater. This contact resistance leads to an increased temperature development, so that additional measures must be taken to keep the temperature from the circuit board, and dissipate them from the device. By implementing the contact of the safety device as a contact rivet which is integrated directly into the circuit board, there is no contact resistance between contact carrier and contact rivet due to the missing contact carrier, and a reduced temperature development is to be expected.

In a direct integration of the contact rivet into the circuit board, the contact rivet is mounted into an opening in the circuit board, in particular riveted or soldered therein or both, so that only a part of the contact rivet is located above the circuit board. In a preferred embodiment, the contact rivet is made of a contact head and a contact shaft, wherein with direct integration of the contact rivet, the contact shaft is mounted into the opening in the circuit board and the contact head is located on the circuit board.

According to a further preferred embodiment, the contact, that is, the contact rivet, is made of pure silver, fine grain silver, in particular AgNi 0.15, a bimetal or a trimetal. According to a further preferred embodiment, the contact, that is, the contact rivet, is made of a first contact part and a second contact part, wherein the first contact part makes contact with the counter contact. In particular, in this embodiment, the contact head of the contact rivet is made of the first contact part and the second contact part. In a further preferred embodiment, the first contact part is made of silver or fine grain silver AgNi 0.15 and the second contact part is made of copper. In a further embodiment, the first and the second contact part are coated with silver or fine grain silver, in particular AgNi 0.15, in order to ensure good solderability. In a further embodiment, only the second contact part is coated with silver or fine grain silver, in particular AgNi 0.15, in order to reduce the proportion of silver in the device and still achieve good solderability.

Integrated directly into the circuit board means in particular that the contact rivet is riveted to the circuit board, soldered or both.

In one embodiment, the contact, in particular the contact rivet, is set up to be soldered to the circuit board, for example, following the riveting.

In a further preferred embodiment, the counter contact is made of pure silver, fine grain silver AgNi 0.15, a bimetal or a trimetal. It is further preferred that the counter contact is made of a first counter contact part and a second counter contact part, wherein the first part makes contact with the contact. It is further preferred that the first counter contact part is made of silver or fine grain silver AgNi 0.15, and the second counter contact part is made of copper. In a further embodiment, the first counter contact part and the second counter contact part or only the second counter contact part is coated with silver or fine grain silver AgNi 0.15 in order to produce a good solderability.

In a further preferred embodiment, the mounting device comprises a contact bridge and a spring and the counter contact is disposed on the contact bridge. In this embodiment, it is further preferred that the contact bridge is U-shaped and the U-shaped contact bridge is connected to a spring in a centre of the contact bridge, said spring connecting the contact bridge to the contact support.

Further, the object is achieved by using a contact rivet as a contact in a safety device according to one of the above embodiments, wherein the contact rivet is integrated directly into the circuit board. Furthermore, the object is also achieved by an instantaneous water heater having a safety device according to one of the above embodiments.

BRIEF DESCRIPTION OF THE DRAWINGS

Further advantageous implementations and embodiments are described below with reference to the attached figures.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
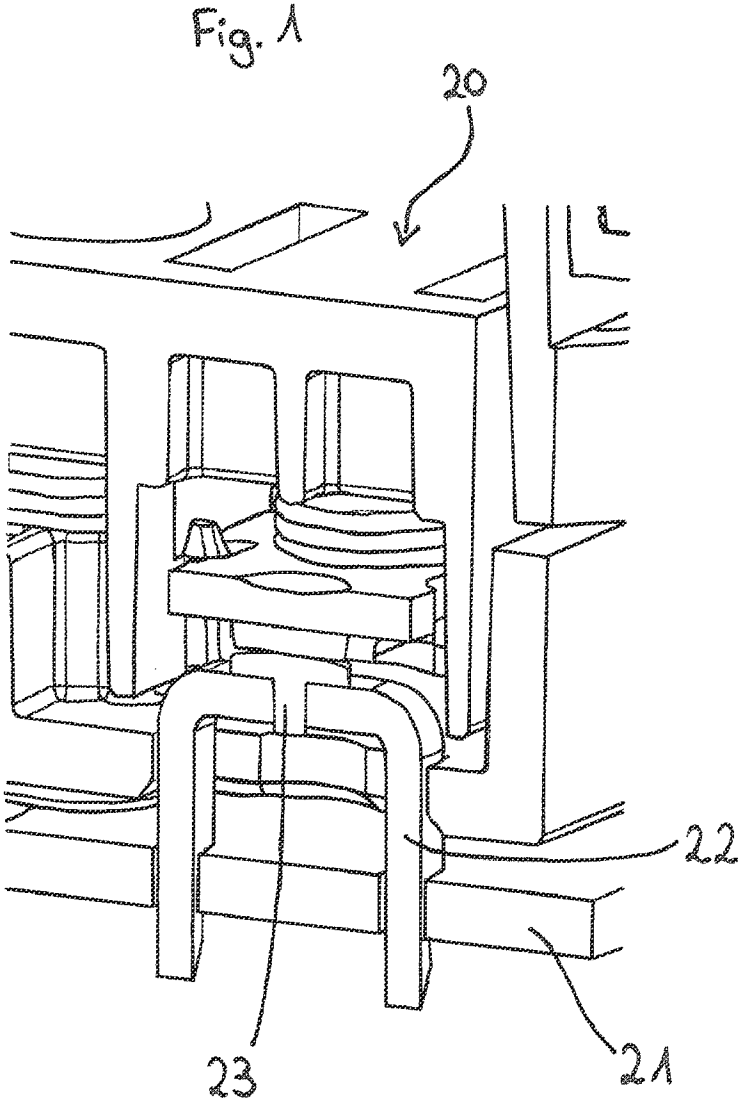
FIG. 1 shows a schematic representation of a safety device according to the prior art up to now.
Figure 2:
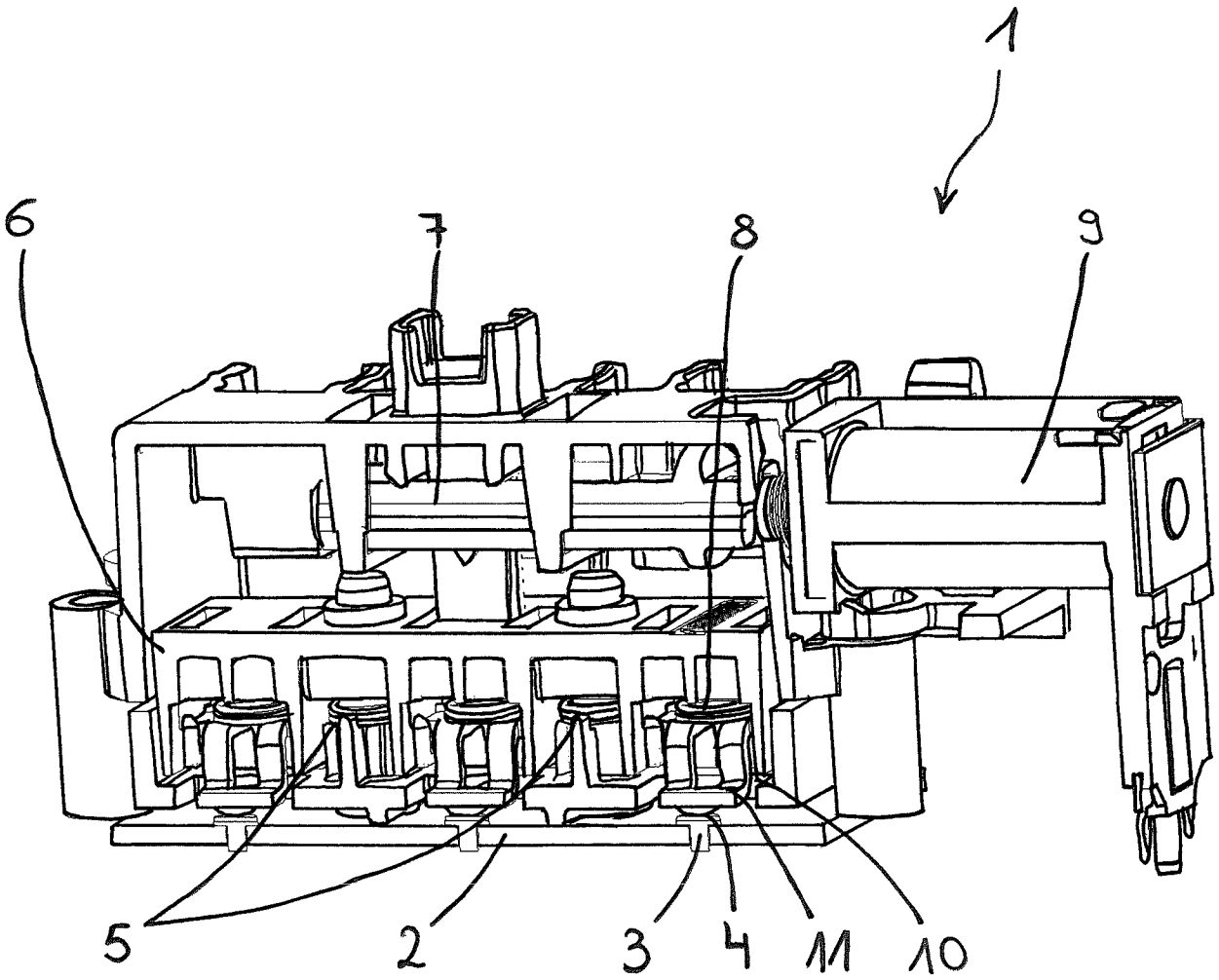
FIG. 2 shows a schematic representation of a safety device according to an exemplary embodiment of the invention.

FIG. 2 shows a schematic representation of the safety device 1 according to an embodiment of the invention. In this case, the safety device 1 in this embodiment comprises a contact 3 and a counter contact 4. Further, the safety device 1 comprises a mounting device, which in turn comprises a U-shaped contact bridge 10 having a widening 11 at the end of each of the arms. The contact bridge 10 is connected to a contact support 6 of the safety device 1 by means of a contact spring 8. Further, the safety device 1 comprises separating springs 5, a tie rod 7 and a coil 9, the function of which is described below.

The contact 3 is implemented in an embodiment according to the invention as a contact rivet and connected directly to a printed circuit board 2, in particular riveted, alternatively soldered. Furthermore, the contact rivet can be connected to the printed circuit board 2 by a combination of riveting and soldering. Thus, the contact 3 is in direct contact with the electrical conduction paths on the printed circuit board 2 used to control and operate the instantaneous water heater.

Figure 3:
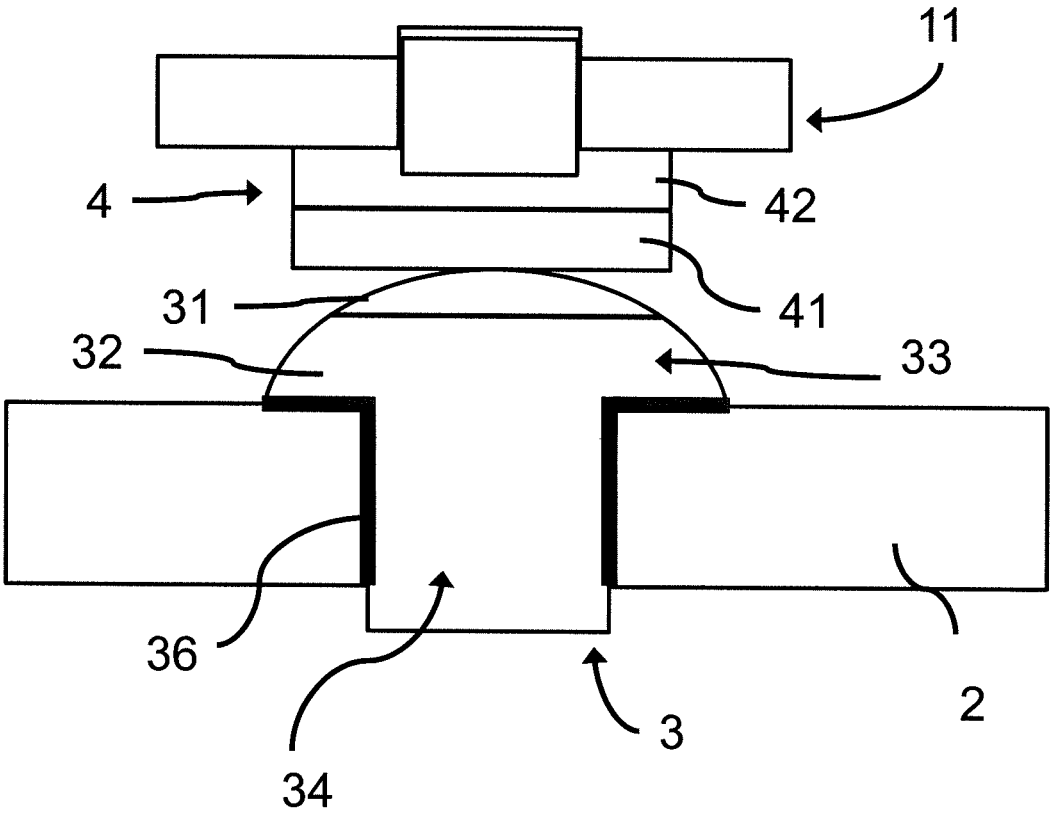
FIG. 3 shows a schematic representation of a contact and a counter contact according to an exemplary embodiment of the invention.

A preferred embodiment of the contact 3 and the counter contact 4 are explained in more detail below with reference to FIG. 3. FIG. 3 shows a schematic representation of a contact 3 and a counter contact 4 according to an exemplary embodiment of the invention. The contact 3 is implemented according to an embodiment of the invention as a contact rivet and comprises a contact head 33 and a contact shaft 34. The contact shaft 34 of the contact 3 is mounted into an opening of the printed circuit board 2 for directly integrating the contact 3, so that only the contact head 33 of the contact 3 projects beyond the printed circuit board 2. In a preferred embodiment, the contact 3 is riveted in the printed circuit board 2. Alternatively or additionally, a soldering agent 36 can be provided in the opening prior to mounting. The contact 3 can then be soldered to the printed circuit board 2. Furthermore, in a preferred embodiment, the contact 3 has a first contact part 31 and a second contact part 32. In a preferred embodiment, the first contact part is made of silver or fine grain silver AgNi 0.15 and the second contact part 32 of the contact 3 is made of copper. The complete contact 3 is coated with silver or fine grain silver AgNi 0.15 to protect against oxidation and for better solderability.

The contact 3 is implemented so that it makes contact with the counter contact 4 during normal operation of the instantaneous water heater. The counter contact 4 is disposed on the widening 11 of the U-shaped contact bridge 10 of the mounting device and implemented as counter contact rivet. In a preferred embodiment, the counter contact 4 also comprises a first counter contact part 41 and a second counter contact part 42. In this case, the first counter contact part 41 is preferably also formed from silver or fine grain silver AgNi 0.15 and the second counter contact part 42 is formed of copper. The counter contact is then also coated with silver or fine grain silver AgNi 0.15.

Figure 4:
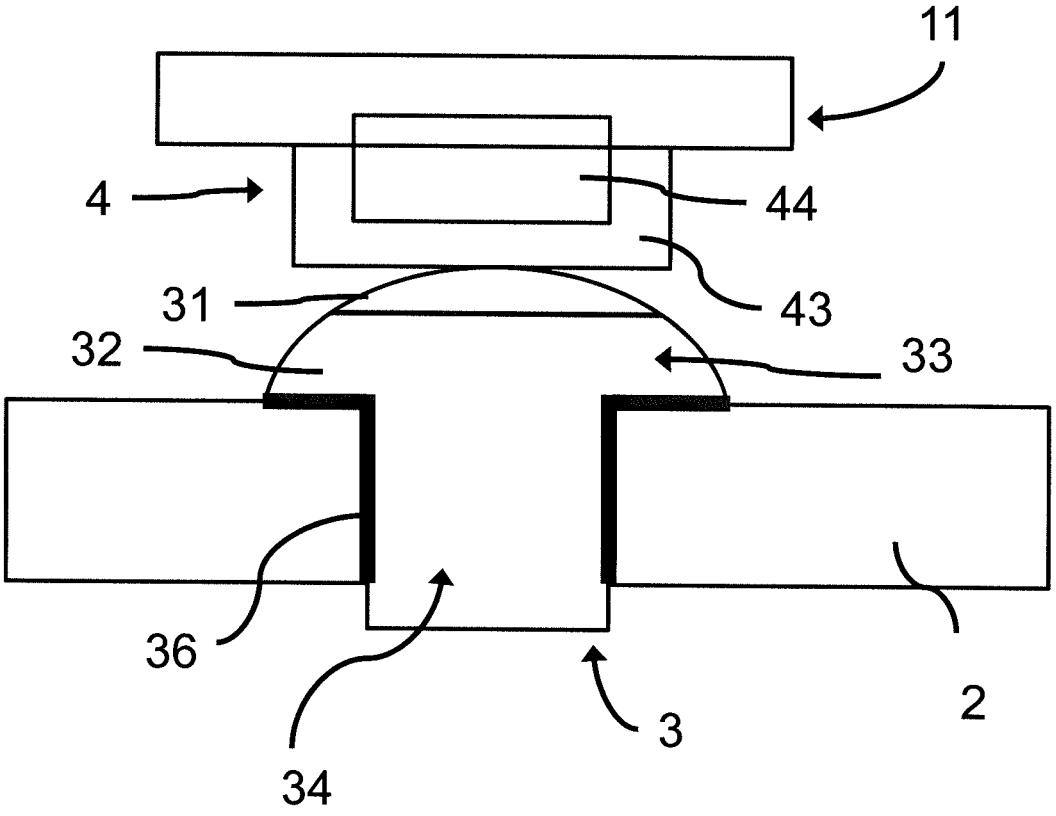
FIG. 4 shows a further schematic representation of a contact and a counter contact according to an exemplary embodiment of the invention.

FIG. 4 shows another embodiment of the counter contact 4. In this embodiment, the widening 11 is embossed and forms a formation 44. The counter contact is cut off by a silver wire and plated over the formation 44. The plated silver wire thus forms a contact layer 43. This embodiment has the advantage that the silver content on the contacts can be reduced and an obstruction of the separation mechanism by protruding parts on the side of the widening 11 opposite the counter contact 4 can be avoided.

The functioning of the safety device 1 according to the invention is now described with reference to FIG. 2. In normal operation of the instantaneous water heater, the tie rod 7 is located in a locked position so that it presses the contact support 6 down against the spring forces of the separating springs 5 and thus also presses the mounting device with the contact bridge 10 down via the contact springs 8. As a result, the counter contact 4, which is located on the contact bridge 10, is pressed against the contact 3 located directly on the circuit board. The current supplying the instantaneous water heater thus flows via the safety device 1 through the counter contact 4 in the contact 3 and is transmitted from contact 3 to the corresponding conductors of the printed circuit board 2. Since the contact 3 is integrated directly into the printed circuit board 2, that is, in direct contact with the conductors applied to the printed circuit board 2 for supplying the instantaneous water heater, the resistance between contact and the circuit paths in the printed circuit board can be kept low and there is a reduced heat development, even at high currents which are needed to operate an instantaneous water heater.

If a fault occurs when operating the instantaneous water heater, the locking of the tie rod 7 by means of the coil 9, which acts as an actuator, is removed and the contact support 6 is displaced upwards by the spring force of the separating springs 5. As a result, the contact between the counter contact 4 and contact 3 is interrupted and a current flow in the instantaneous water heater is only possible again when a user manually brings the contact support 6 into the lower end position, whereby this is again locked by a spring integrated in the coil via the tie rod 7. This ensures safe use of the instantaneous water heater.

Although the mounting device comprises a U-shaped contact bridge 10 in the embodiment described above, in another embodiment, the mounting device can also comprise a differently shaped contact bridge, for example, a V-shaped contact bridge, or the mounting device could be implemented such that the contact bridge 10 is connected directly to the contact spring 8.

Although the contact bridge 10 comprises widenings 11 for attaching the counter contact 4 in the above embodiment, in another embodiment, the attachment of the counter contacts 4 to the contact bridge 10 can be implemented differently and in particular comprise no widening.

Although the contact 3 and the counter contact 4 are implemented as a bimetal having a fine grain silver part and a copper part in the embodiment described above, in another embodiment, the contact 3 and the counter contact 4 can also be made of a single conductive material or comprise more than two parts of different metals. In addition, the first and second parts of the contact and/or counter contact could be made of metals other than those described above.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope

The invention claimed is:

1. A safety device for emergency shut-down of an electric water heater or a heat pump, the safety device comprising:

a contact and a counter contact, which are configured, in a contacted state, to supply power to the water heater or heat pump, and are configured, in an open state, to interrupt the power supplied to the water heater or heat pump; and a mounting device configured to mount the counter contact on a tie rod, the tie rod being configured to release the mounting device and the counter contact from the contact to interrupt the power supplied to the water heater or heat pump;

wherein the contact is implemented as a contact rivet that is integrated directly into a circuit board.

2. The safety device according to claim 1;

wherein the contact, the counter contact, or both are made of pure silver, fine grain silver, a bimetal, or a trimetal.

3. The safety device according to claim 1;

wherein the contact comprises:

a first contact part; and a second contact part;

wherein the first contact part is configured to make contact with the counter contact when the contact and counter contact are in the contacted state.

4. The safety device according to claim 3;

wherein the first contact part comprises silver; and wherein the second contact part comprises copper.

5. The safety device according to claim 1;

wherein the contact rivet configured to be soldered to the circuit board.

6. The safety device according to claim 1;

wherein the counter contact comprises:

a first counter contact part; and a second counter contact part;

wherein the first counter contact part is configured to make contact with the contact when the contact and counter contact are in the contacted state.

7. The safety device according to claim 6;

wherein the first counter contact part comprises silver.

8. The safety device according to claim 7;

wherein the second counter contact part comprises copper.

9. The safety device according to claim 1;

wherein the contact, the counter contact, or both are coated with a layer comprising silver.

10. The safety device according to claim 1;

wherein the mounting device comprises:

a contact bridge; and a spring;

wherein the counter contact is disposed on the contact bridge.

11. The safety device according to claim 10;

wherein the contact bridge is U-shaped and the U-shaped contact bridge is connected in a centre of the contact bridge to a spring that connects the contact bridge to the contact support.

12. An instantaneous water heater comprising:

the safety device according to claim 1.

13. A method comprising:

utilizing a contact rivet integrated directly into a circuit board as a contact in a safety device for emergency shut-down of an electric water heater or a heat pump;

wherein the safety device comprises:

the contact and a counter contact, which are configured, in a contacted state, to supply power to the water heater or heat pump, and are configured, in an open state, to interrupt the power supplied to the water heater or heat pump; and a mounting device configured to mount the counter contact on a tie rod, the tie rod being configured to release the mounting device and the counter contact from the contact to interrupt the power supplied to the water heater or heat pump.

* * * * *